US011692414B2

(12) United States Patent
Hiorth et al.

(10) Patent No.: US 11,692,414 B2
(45) Date of Patent: Jul. 4, 2023

(54) WELL TOOL DEVICE FOR OPENING AND CLOSING A FLUID BORE IN A WELL

(71) Applicant: Interwell Norway AS, Hafrsfjord (NO)

(72) Inventors: Espen Hiorth, Trondheim (NO); Stig Ove Bjørgum, Voss (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 17/814,403

(22) Filed: Jul. 22, 2022

(65) Prior Publication Data

US 2022/0356780 A1 Nov. 10, 2022

Related U.S. Application Data

(63) Continuation of application No. 16/981,863, filed as application No. PCT/EP2019/058665 on Apr. 5, 2019, now Pat. No. 11,428,071.

(30) Foreign Application Priority Data

Apr. 25, 2018 (NO) ..... 20180579

(51) Int. Cl.
*E21B 34/06* (2006.01)
*E21B 34/10* (2006.01)

(52) U.S. Cl.
CPC ..... *E21B 34/063* (2013.01); *E21B 34/103* (2013.01)

(58) Field of Classification Search
CPC ..... E21B 34/063; E21B 34/103; E21B 33/12; E21B 33/1208; E21B 33/134
See application file for complete search history.

(56) References Cited

U.S. PATENT DOCUMENTS 4,813,481 A 3/1989 Sproul et al.
4,991,654 A 2/1991 Brandell et al.
(Continued)

FOREIGN PATENT DOCUMENTS

EP 2978926 B1 5/2017
WO 2012066282 A2 5/2012
(Continued)

OTHER PUBLICATIONS

International Search Report issued in International Application No. PCT/EP2019/058665; dated Jul. 2, 2019 (4 pages).
(Continued)

*Primary Examiner* — Steven A MacDonald
(74) *Attorney, Agent, or Firm* — Osha Bergman Watanabe & Burton LLP

(57) ABSTRACT

A well tool device includes a housing having an axial through bore; a sleeve section axially displaceable relative to the housing; a fluid flow preventing frangible disc; and an axial fluid passage bypassing the frangible disc when the well tool device is in an initial state, thereby allowing a fluid flow between a first location above the frangible disc and a second location below the frangible disc. The sleeve section includes an axial through bore aligned with the axial through bore of the housing. The axial fluid passage is closed when the well tool device is in a intermediate state. The fluid flow preventing frangible disc is provided in the bore of the sleeve section in sealing engagement with the sleeve section. The well tool device further includes a disc supporting device for supporting the frangible disc in relation to the sleeve section. The disc supporting device is releasably connected inside the sleeve section by a releasable connection device. The well tool device further includes a disintegration device disintegration of the frangible disc. The well tool device is in a final state when the frangible disc has been
(Continued)

disintegrated by the disintegration device. The frangible disc is configured to be pushed axially relative to the sleeve section towards the disintegration device after release of the disc supporting device.

11 Claims, 4 Drawing Sheets

(56) References Cited

U.S. PATENT DOCUMENTS

| | | | | |
|---|---|---|---|---|
| 5,193,621 | A | 3/1993 | Manke et al. | |
| 5,341,883 | A | 8/1994 | Ringgenberg | |
| 6,293,342 | B1 | 9/2001 | McGarian et al. | |
| 8,833,468 | B2 | 9/2014 | Swan | |
| 8,931,559 | B2 | 1/2015 | Getzlaf et al. | |
| 9,133,684 | B2 | 9/2015 | Hofman et al. | |
| 9,194,205 | B2 | 11/2015 | Brandsdal et al. | |
| 9,371,715 | B2 | 6/2016 | George et al. | |
| 9,441,440 | B2 | 9/2016 | Hofman et al. | |
| 9,476,273 | B2 | 10/2016 | Acosta et al. | |
| 9,587,452 | B2 | 3/2017 | Bjorgum | |
| 9,683,424 | B2 | 6/2017 | Cleven | |
| 9,732,579 | B2 * | 8/2017 | Hiorth | E21B 33/12 |
| 9,850,742 | B2 | 12/2017 | Beck et al. | |
| 9,874,067 | B2 | 1/2018 | Themig et al. | |
| 9,915,122 | B2 | 3/2018 | Hofman et al. | |
| 11,293,260 | B2 * | 4/2022 | Dharne | E21B 34/063 |
| 11,313,199 | B2 * | 4/2022 | Saraya | E21B 34/14 |
| 11,332,999 | B1 * | 5/2022 | Eriksen | E21B 33/1208 |
| 11,428,071 | B2 * | 8/2022 | Hiorth | E21B 34/063 |
| 11,441,382 | B1 * | 9/2022 | Eriksen | E21B 33/1208 |
| 2008/0073075 | A1 * | 3/2008 | Buyers | E21B 33/1208 166/188 |
| 2009/0101358 | A1 * | 4/2009 | Bjorgum | E21B 34/063 166/376 |
| 2011/0000663 | A1 | 1/2011 | Brandsdal | |
| 2011/0284242 | A1 * | 11/2011 | Frazier | E21B 34/063 166/376 |
| 2012/0312557 | A1 * | 12/2012 | King | E21B 34/103 166/194 |
| 2013/0292119 | A1 | 11/2013 | Hilliard et al. | |
| 2013/0292133 | A1 * | 11/2013 | Thompson | E21B 34/06 166/373 |
| 2014/0008085 | A1 * | 1/2014 | Tinnen | E21B 33/134 166/134 |
| 2014/0076578 | A1 | 3/2014 | Hofman et al. | |
| 2014/0251636 | A1 | 9/2014 | Hofman et al. | |
| 2015/0176361 | A1 | 6/2015 | Prosser et al. | |
| 2015/0233208 | A1 | 8/2015 | Muscroft et al. | |
| 2016/0060998 | A1 * | 3/2016 | Hiorth | E21B 33/12 166/192 |
| 2016/0281455 | A1 * | 9/2016 | Brandsdal | E21B 33/1208 |
| 2017/0335657 | A1 * | 11/2017 | Abney | E21B 34/142 |
| 2018/0080308 | A1 * | 3/2018 | Dedman | E21B 34/063 |
| 2019/0017345 | A1 * | 1/2019 | Brandsdal | E21B 34/063 |
| 2019/0032448 | A1 * | 1/2019 | Bjørgum | E21B 34/063 |
| 2020/0115989 | A1 * | 4/2020 | Hiorth | E21B 33/1208 |
| 2020/0182007 | A1 * | 6/2020 | Kent | E21B 34/063 |
| 2021/0108476 | A1 * | 4/2021 | Brandsdal | E21B 33/1208 |
| 2021/0238942 | A1 * | 8/2021 | Stratton | E21B 33/1208 |

FOREIGN PATENT DOCUMENTS

| | | | |
|---|---|---|---|
| WO | 2012/149638 | A1 | 11/2012 |
| WO | 2019/011563 | A1 | 1/2019 |

OTHER PUBLICATIONS

Written Opinion issued in International Application No. PCT/EP2019/058665; dated Jul. 2, 2019 (7 pages).

Search Report issued in Norwegian Application No. 20180579; dated Nov. 16, 2018 (2 pages).

Interwell Ltd. "Product Sheet: Inter Remote Shatter Valve (!RSV) Product Description Product Application" Internet Advertisement; Jun. 6, 2017 (2 pages).

* cited by examiner

WELL TOOL DEVICE FOR OPENING AND CLOSING A FLUID BORE IN A WELL

FIELD OF THE INVENTION

The present invention relates to a well tool device for opening and closing a fluid bore in a well. In particular, the present invention relates to a well tool device having a temporary open state, a temporary closed state and a permanent open state.

BACKGROUND OF THE INVENTION

In different types of well operations, it is a need for well tool devices having a valve function, i.e. the well tool device needs to be reconfigured between an open state and a closed state.

Typically, the closed state is used for pressure testing purposes to ensure that the well integrity is intact. The open state is typically during production, to allow hydrocarbon fluids to be transported from the well to the topside of the well. During the installation of the completion string or tubing, it is preferred that the tubing is open, so well fluid can flow into the tubing during the lowering of the tubing into the well.

When the tubing is landed in the well head and the pressure control equipment is installed above the tubing/well head, it is desired to replace the heavy well fluid with a lighter completion fluid before the production packer is installed. In such a case, completion fluid is pumped down into the tubing and return fluid is received through the annulus. Again, during such operations, the tubing must be open.

In some operations, the open state is also used for pressure testing purposes.

One such known well tool device is the Inter Remote Shutter Valve (IRSV), marketed by Interwell. The IRS V is initially closed and may be connected to the lower part of the completion string. When the completion string is installed, the completion string above the IRSV may be pressure tested to ensure that the production tubing is properly installed. After testing, the IRSV is opened by crushing a glass disc within the IRSV. When open, it is possible to test the production packer outside of the completion string before production starts.

The IRSV may also be used in other well tools, such as plugs (for example the Interwell ME plug, the Interwell HPHT plug etc).

The IRSV is described in the "Product Sheet: Inter Remote Shatter Valve (IRSV)" Rev. 4.0 dated 27 Sep. 2016.

U.S. Pat. No. 9,194,205, in the name of TCO AS, describes a device for a system for conducting tests of a well, pipe or the like. In the device, a plug of a removable material is inserted in a pipe through a well to carry out said tests. The device is characterized in that the wall parts of the pipe comprise channel borings that set up fluid connections between the well space and the well space above and below, respectively, the plug, and that it comprises a closing body that can close the fluid connection permanently. The channel boring is preferably defined by an axial hollow space/chamber in which a piston is arranged, said piston can be readjusted by an axial movement from a first position where there is fluid connection through the channel and a second position where the connection is permanently closed and cannot be reopened.

US 2011/0000663, in the name of TCO AS, describes a device for removal of a plug which is used in a well, a pipe, or the like for carrying out tests, and it is characterized by an element which, with an applied forced, is arranged to penetrate into the plug material so that this is crushed, said element is arranged to be supplied said force from an above lying element. The element is preferably a ring the lower end of which is arranged to be forced in a radial direction into the plug element at axial driving of a hydraulic pressure piston. Furthermore, the element is integrated into the plug.

It is also known to use ball valves in the lower end of the completion string, for testing of the production tubing and the production packer. However, if the ball valve fails, it is needed to mill out the ball valve or to remove the completion string. None of these operations are desired. Moreover, such valves often have a increased outer diameter or a reduced inner diameter. An increased outer diameter will make it difficult to insert the completion string, while a reduced inner diameter will reduce the flow rate capacity of the completion.

WO 2012066282A2 discloses a valve assembly which is configured to be coupled to a tubing string. It comprises a housing defining a housing flow path for communicating with the tubing string, and a barrier member located in the housing and configurable between a normally-closed position in which the barrier member restricts access through the housing flow path, and an open position in which access is permitted through the housing flow path. The valve assembly also comprises a bypass arrangement reconfigurable between an open state in which the bypass arrangement defines a bypass flow path that communicates with the housing flow path on opposite sides of the barrier member to permit fluid to bypass the barrier member and thereby fill the tubing string. One object of the present invention is to add functionality to the IRSV above. One such added functionality is to provide the IRSV with an initial open state. Hence, it is achieved that it is not necessary to fill fluid into the completion when adding new pipe sections to the completion string.

One object of the invention is to achieve a well tool device where the inner diameter is not substantially reduced or where the outer diameter of the device is not substantially increased. Accordingly, the object is that the outer diameter of the well tool device is equal to or substantially equal to the outer diameter of the completion string the device is connected to, and that the inner diameter of the well tool device is equal to or substantially equal to the inner diameter of the completion string the device is connected to. In this case, the outer diameter of the well tool device should be equal to or less than the outer diameter of for example the safety valve, which has an outer diameter typically somewhat larger than the outer diameter of the tubing segments.

To save time and resources, the completion string is run into the drilling fluid. After the installation of the completion string, the drilling fluid is circulated out and replaced by a completion fluid before the production packer is set. The object of the invention is to provide a circulation valve with an initial open state, an intermediate closed state and a final open state.

In some wells with a low reservoir pressure, a light weight fluid is often circulated into the completion string before the well is opened for production, as this light weight fluid will contribute to production flowing out from the reservoir. Also in such a case it is preferred to have an initial open completion string.

Another object of the invention is that it should be connectable to the upper part of the completion string, adjacent to, but below, the tubing hanger. Here, the well tool device serves the function of a second, upper barrier of the well, assuming that a first, lower barrier also is present in the well. The first barrier can be a prior art barrier, such as a plug set in the completion string, or it may be another well tool device according to the present invention.

SUMMARY OF THE INVENTION

In the present description, the term "upper" and "lower" are used. Here, the part referred to as "upper" is relatively closer to the top of the well than the part referred to as "lower", i.e. the part referred to as "lower" is closer to the bottom of the well, irrespective of the well being a horizontal well, a vertical well or an inclining well.

The present invention relates to a well tool device comprising a housing having an axial through bore, where the well tool device is comprising:

- a sleeve section axially displaceable relative to the housing, where the sleeve section comprises an axial through bore aligned with the axial through bore of the housing;
- a fluid flow preventing frangible disc;
- an axial fluid passage bypassing the frangible disc when the well tool device is in an initial state, thereby allowing a fluid flow between a first location above the frangible disc and a second location below the frangible disc;

where the axial fluid passage is closed when the well tool device is in a subsequent state;

where:

- the fluid flow preventing frangible disc is provided in the bore of the sleeve section in sealing engagement with the sleeve section;
- the well tool device further comprises a disc supporting device for supporting the frangible disc in relation to the sleeve section, where disc supporting device is releasably connected inside the sleeve section by means of a releasable connection device;
- well tool device further comprises a disintegration device for disintegration of the frangible disc, where the well tool device is in a final state when the frangible disc has been disintegrated by means of the disintegration device.

Hence, in the initial or first state, the fluid flow between the first and second locations are allowed only via the axial fluid passage. In the intermediate or second state, fluid flow between the first and second locations are prevented. In the final or third state, the frangible disc is broken, and fluid flow is allowed through the bores. In the final state, the axial fluid passage is still closed.

The disc supporting device is supporting the frangible disc in relation to the sleeve section until the disc supporting device released from the sleeve section. Preferably, the disc supporting device is connected to the sleeve section in the initial state and in the intermediate state, while the disc supporting device is released from the sleeve section in the final state.

In one aspect, the sleeve section is moved axially upwards in relation to the housing from the initial state to the intermediate state. Alternatively, the sleeve section is moved axially downwards in relation to the housing from the initial state to the intermediate state.

In one aspect, the well tool device comprises a sleeve locking system for preventing relative axial displacement between the housing and the sleeve section when the well tool device is in the intermediate state.

Hence, the well tool device cannot return from its intermediate state to its initial state again.

In one aspect, the sleeve locking system comprises:

- a first recess provided in the bore of the housing;
- a second recess provided in an outer surface of the sleeve section, where the first and second recesses are axially aligned in the intermediate state;
- a pre-tensioned locking device provided in the first or second recess, where the locking device is configured to lock the first and second recesses to each other in the intermediate state.

The pre-tensioned locking device can be a pre-tensioned locking ring, a spring-biased locking pin, a ratchet ring, etc.

The pre-tensioned locking device can be a pre-compressed locking ring or a so-called snap ring, which in the initial state is provided in the second recess. When the recesses are aligned with each other in the intermediate state, the locking ring expands partially into the first recess and hence prevents relative axial movement between the housing and the sleeve section. Alternatively, the pre-tensioned locking device is a pre-expanded locking ring, which in the initial state is provided in the first recess. When the recesses are aligned with each other in the intermediate state, the locking ring retracts partially into the second recess and hence prevents relative axial movement between the housing and the sleeve section.

The well tool device may comprise an upper connection interface and/or a lower connection interface for connection to a completion pipe, production tubing etc. In the initial state, fluids above and/or below the well tool device can be exchanged via the axial fluid passage. In the intermediate state, pressure testing can be performed. In the third state, the well tool device allows full production through the bores.

In one aspect, the well tool device is comprising a first actuating system for moving the sleeve section axially in relation to the housing from the initial state to the intermediate state.

In one embodiment, the axially displaceable sleeve section is releasably connected to the housing in the first state. This connection could be provided by a shear pin etc., which are sheared off at a predetermined load.

Alternatively, it is possible to move the sleeve section axially by means of controlling the fluid rate through the axial fluid passage. If an upwardly directed fluid flow rate is increased to a certain level determined by the cross-sectional area of the passage, an increase in the pressure below the frangible disc will occur. This increased pressure could be used to move the sleeve section axially in relation to the housing from the initial state to the intermediate state.

In one aspect, the first actuating system comprises:

- a valve control system;
- a valve controlled by the valve control system;
- a first fluid line provided between the bore and the valve;
- a piston axially displaceable within a piston cylinder;
- a second fluid line provided between a first side of the piston and the valve;

where a second side of the piston is connected to the sleeve section;

where the valve is preventing fluid flow between the bore and the first side of the piston in the initial state;

where the valve is allowing fluid flow between the bore and the first side of the piston in the intermediate state, thereby causing linear movement of the piston within the piston cylinder and hence axial movement of the sleeve section.

The second side of the piston can be connected to the sleeve section by means of a piston rod provided at least partially within the piston cylinder. Alternatively, a further piston can be provided in the fluid cylinder or in fluid communication with the fluid cylinder, where the further piston is connected to the sleeve section. Here, the linear movement of the piston will cause the linear movement of the further piston and hence the sleeve section.

The fluid actuating system is preferably located in compartments provided in the housing, i.e. radially between the bore and the outer surface of the housing.

The valve control system may comprise an electric actuator for controlling the valve. The electric actuator can control the valve to open at a predetermined time by using a timer, at a signal detected by a sensor, for example a signal in the form of hydraulic pulses detected by a pressure sensor, electromagnetic signals detected by an antenna etc.

In the initial state, the pressure within the fluid cylinder is lower or substantially lower than the expected well pressure in the well. Typically, the pressure within the fluid cylinder will have a so-called atmospheric pressure in the initial state. This so-called atmospheric pressure is achieved by ensuring that the well tool device is in the initial state, and then open and close a pressure-sealed entry into the fluid cylinder topside before the well operation starts, or during manufacturing. Hence, the so-called atmospheric pressure typically corresponds to the air pressure surrounding the well tool device at the time when the fluid cylinder becomes closed. It should be noted that the atmospheric pressure typically varies dependent on the height above sea level. When the well tool device is lowered into an oil and/or gas well, the fluid pressure in the well will be substantially higher than the pressure in the fluid cylinder, which will cause the piston to move linearly inside the piston cylinder when the valve 52 is opened. Hence, variations in the so-called atmospheric pressure is neglectable with respect to the fluid pressure in the well.

In one aspect, the housing comprises a first stop profile within the bore and the sleeve section comprises a second stop profile on its outer surface, where the second stop profile is engaged with the first stop profile in the intermediate state.

In one aspect, the well tool device is comprising a second actuating system for releasing the releasable connection device, thereby causing a release of the disc supporting device from the sleeve section.

In one aspect, the disintegration device is fixed to the sleeve section within the bore of the sleeve section on the same side of the frangible disc as the disc supporting device. When the releasable connection device has been released by the second actuating system, relative movement between the frangible disc and the sleeve section is possible in one direction, as such movement is no longer prevented by the disc supporting device. Hence, the well tool device is configured to be brought from the intermediate or second state to the final state by means of two steps:

First, the releasable connection device is actuated to release the disc supporting device.

Second, the frangible disc is configured to be pushed axially relative to the sleeve section towards the disintegration device.

The second step can be performed by increasing the fluid pressure on one side of the frangible disc. Preferably, the disintegration device and the disc supporting device are located below the frangible disc. Hence, the frangible disc is pushed downwardly towards the disintegration device by increasing the fluid pressure above the frangible disc.

In one aspect, the second actuating system comprises:

a valve control system;

a valve controlled by the valve control system;

a first fluid line provided between the bore and the valve;

a piston axially displaceable within a piston cylinder;

a second fluid line provided between a first side of the piston and the valve;

where a second side of the piston is connected to the releasable connection device;

where the valve is preventing fluid flow between the bore and the first side of the piston in the initial state and intermediate state;

where the valve is allowing fluid flow between the bore and the first side of the piston to initiate the final state, thereby causing linear movement of the piston within the piston cylinder and hence release of the releasable connection device.

In one aspect, the second actuating system and the releasable connection device are provided on opposite sides of the frangible disc.

In one aspect, a piston rod is in one end connected to the second side of the piston, and is in a second end provided in contact with an actuating rod of the releasable connection device.

In one aspect, the actuating rod is provided in an axial bore provided in the sleeve section.

The second actuating system is similar to, or identical to, the first actuating system. If both actuating systems are actuated by a number of pressure cycles, the first actuating system must be designed to actuate the valve after fewer pressure cycles than the second actuating system, to ensure correct operation of the tool.

BRIEF DESCRIPTION OF THE DRAWINGS

Embodiments of the invention will now be described in detail, with reference to the enclosed drawings, where.

DETAILED DESCRIPTION

Figure 6:
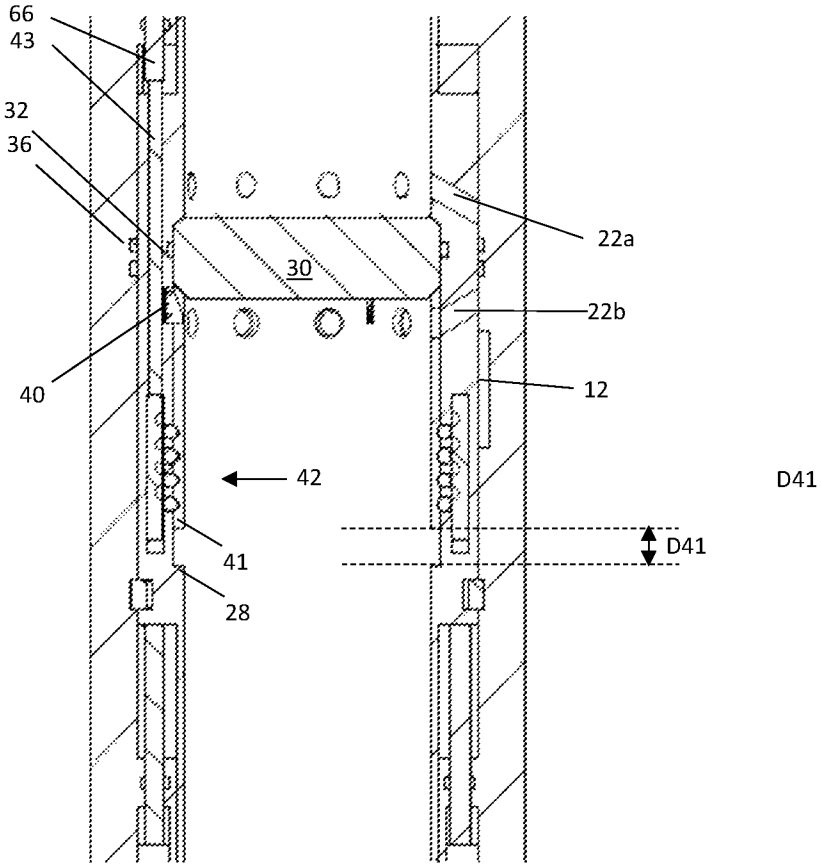
FIG. 6 illustrates an enlarged view of FIG. 2.
Figure 7:
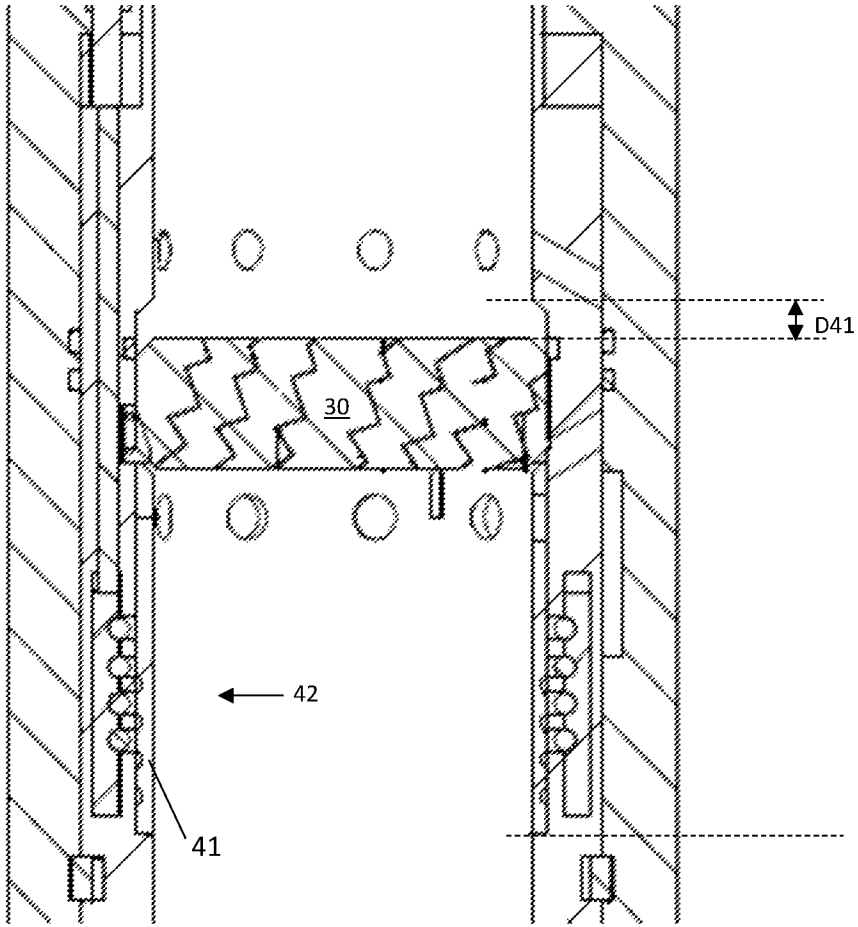
FIG. 7 illustrates an enlarged view of FIG. 3.

It is now referred to FIG. 1-4. In FIG. 1-4, the left side of the drawings are facing towards the upper side of the well, while the right side of the drawings are facing towards the lower side of the well. In FIG. 5-7, the upper side of the drawings are facing toward the upper side of the well, while the lower side of the drawings are facing towards the lower side of the well.

Figure 1:
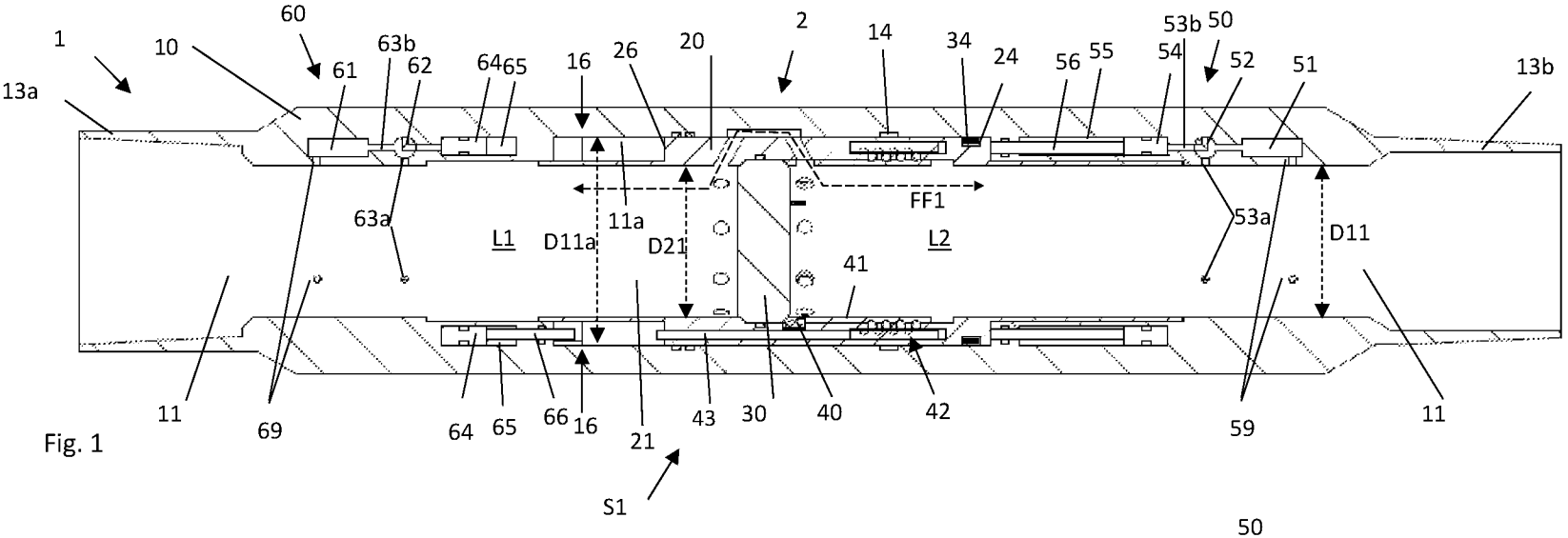
FIG. 1 illustrates a cross sectional view of the well tool device in an initial state.
Figure 2:
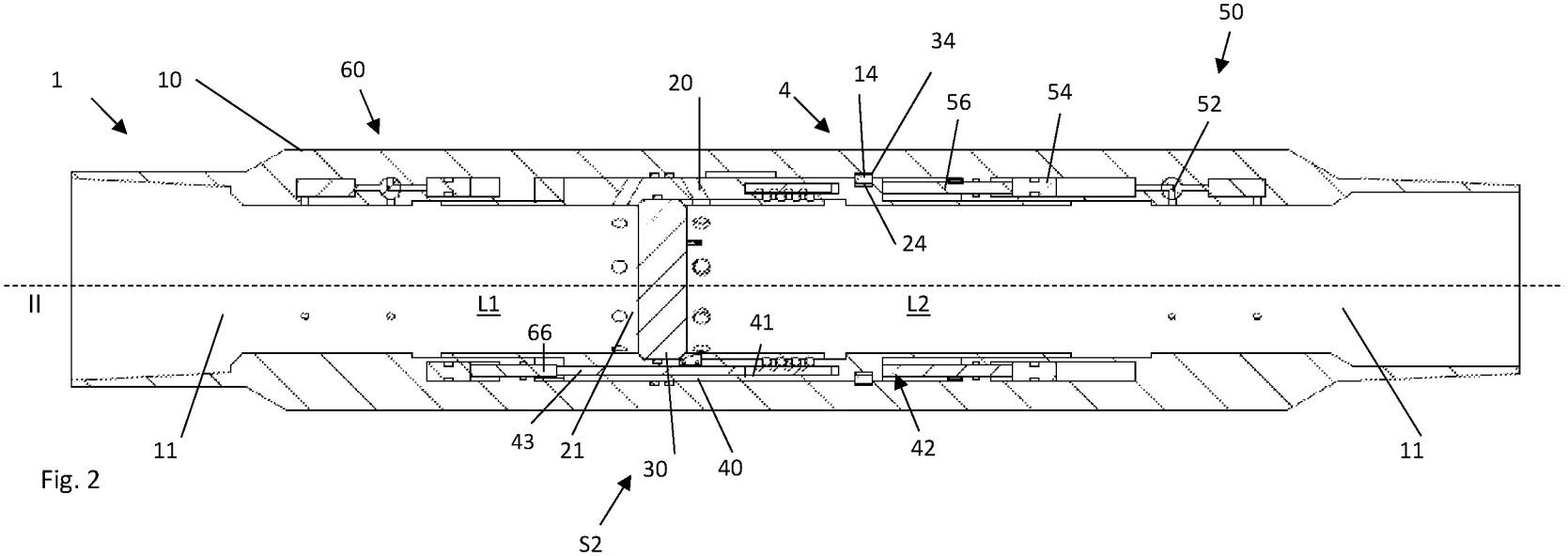
FIG. 2 illustrates a cross sectional view of the well tool device in an intermediate state.
Figure 3:
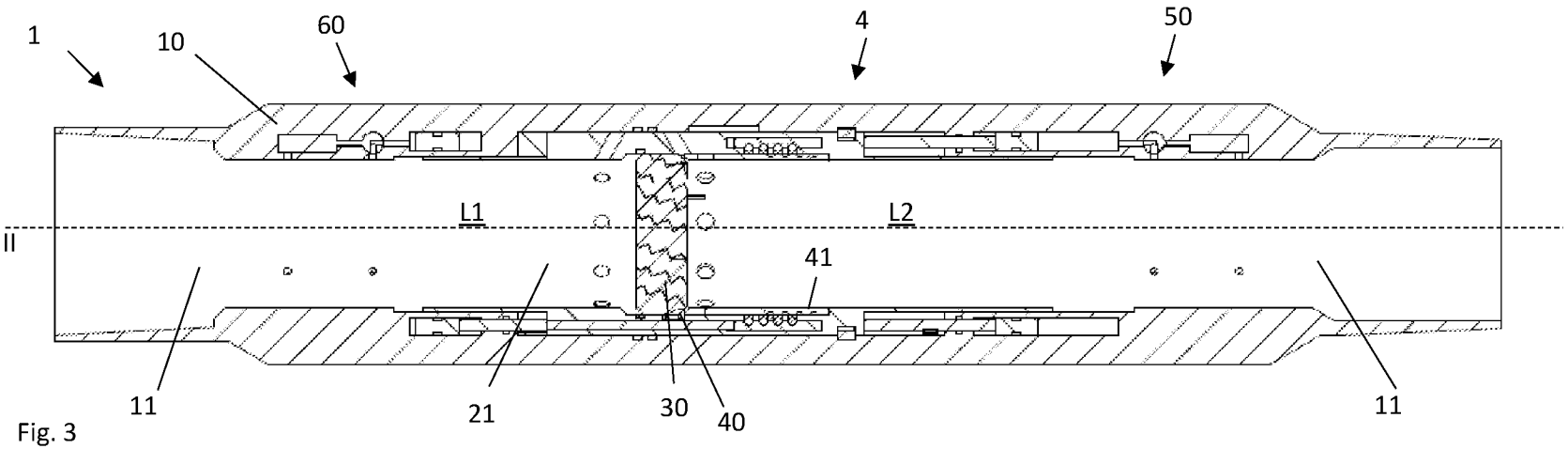
FIG. 3 illustrates a cross sectional view of the well tool device in a first phase of a final state.

A well tool device 1 is generally referred to with reference number 1. In FIGS. 1 and 5, the well tool device 1 is in an initial state S1. In FIGS. 2 and 6, the well tool device 1 is in an intermediate state S2. In FIGS. 3 and 7, the well tool device 1 is in a first phase of a final state S3, while in FIG. 4, the well tool device 1 is in a second phase of the final state S3. These states S1, S2 and S3 will be described in detail together with the well tool device 1 below.

The well tool device 1 comprises an outer housing 10 with an axial through bore 11. The well tool device 1 comprises an upper connection interface 13*a* and a lower connection interface 13*b* for connection to a completion pipe, production tubing etc. These connection interfaces 13*a*, 13*b* may be threaded connection interfaces, or other types of connection interfaces. The axial through bore 11 has a diameter D11 which is typically equal to the inner diameter of the completion pipe, production tubing etc.

A longitudinal central axis II of the well tool device 1 is indicated in FIGS. 2 and 3.

One section 11*s* of the axial through bore 11 has a larger diameter D11*a* than the diameter D11. This section 11*a* forms a compartment for a sleeve section 20. The sleeve section 20 is axially displaceable relative to the housing 10. The sleeve section 20 comprises an axial through bore 21 aligned with the axial through bore 11 of the housing 10. The axial displacement of the sleeve section 20 is limited by the length of the section 11*a* of the bore 11. In FIG. 1, it is shown that the housing 10 comprises a first stop profile 16 within the bore 11. This first stop profile 16 forms the border between the bore 11 and the bore 11*a*. The sleeve section 20 comprises a second stop profile 26 on its outer surface, where the second stop profile 26 is engaged with the first stop profile 16 in the intermediate state S2.

In addition, the axial displacement of the sleeve section 20 is limited by a sleeve locking system 4, which will be described more in detail below.

The axial through bore 21 has an inner diameter D21 which is equal to the diameter D11 of the bore 11. Hence, the sleeve section 20 itself does not limit fluid flow through the well tool device 1 substantially.

The well tool device 1 further comprises a fluid flow preventing frangible disc 30 provided in the bore 21 in sealing engagement with the sleeve section 20. As is known from prior art, the frangible disc 30 is typically made of hardened glass, and is shaped as a cylinder with chamfered upper and lower edges. These chamfered upper and lower edges are supported in a so-called seat in the sleeve section 20. In FIG. 5, it is shown that an o-ring 32 is provided radially between the frangible disc 30 and the sleeve section 20. Hence, as long as the disc 30 is present in the sleeve section 20, axial fluid flow through the bore 21 of the sleeve section 20 is prevented.

As shown in FIG. 5, o-rings 36 is also provided radially between the sleeve section 20 and the housing 10, i.e. radially outside of the sleeve section 20 and radially inside of the housing 10. These o-rings 36 prevents axial fluid flow through the bore 11 and bore 11*a*, on the outside of the sleeve section 20. The o-rings 36 are axially displaced at a distance D36 above the o-ring 32 of the disc 30. In FIG. 6, it is shown that the o-ring 32 is axially (vertically in FIG. 5) aligned with the o-rings 36.

The axially displaceable sleeve section 20 can be releasably connected to the housing 10 in the first state S1. This connection could be provided by a shear pin (not shown), which are sheared off at a predetermined load.

Devices 40, 41 and 42

In the present embodiment, the well tool device 1 comprises a disc supporting device 41 for supporting the frangible disc 30 in relation to the sleeve section 20. The upper chamfered edge of the disc 30 and the side surface of the disc 30 are supported by the sleeve section 20, while the lower chamfered edge of the disc 30 is supported by the upper supporting surface 41*a* of the disc supporting device 41. Hence, when the disc supporting device 41 is removed, nothing prevents the disc 30 from being pushed axially downwards in relation to the sleeve section 20. When comparing FIGS. 6 and 7, it is shown that the disc supporting device 41 can be moved downwardly a distance D41 with respect to the sleeve section 20, corresponding to a distance between the lower end of the disc supporting device 41 and a stop 28 provided as part of the sleeve section 20.

The disc supporting device 41 is releasably connected inside the sleeve section 20 by means of a releasable connection device 42. The releasable connection device 42 is a cycle actuated mechanism described in prior art EP2978926B.

The well tool device 1 further comprises a disintegration device 40 for disintegration of the frangible disc 30. The disintegration device 40 is fixed to the sleeve section 20, within the bore 21 and is located at a short distance below the frangible disc 30. The disintegration device 40 is provided at a distance below frangible disc 30 which is shorter than the distance D41. Hence, when the disc supporting device 41 is released from the sleeve section 20, the disc 30 may be pushed downwardly into contact with the disintegration device 40, thereby causing disintegration of the disc 30.

Axial Fluid Passage 2

Figure 4:
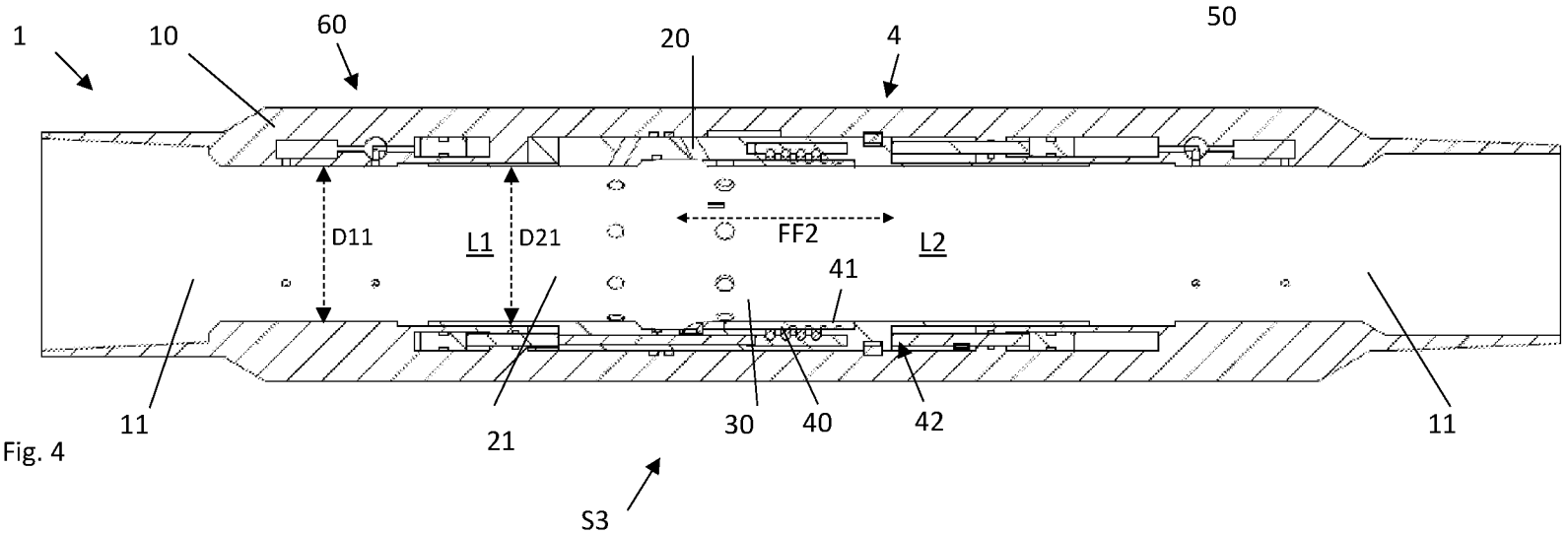
FIG. 4 illustrates a cross sectional view of the well tool device in a second phase of the final state.
Figure 5:
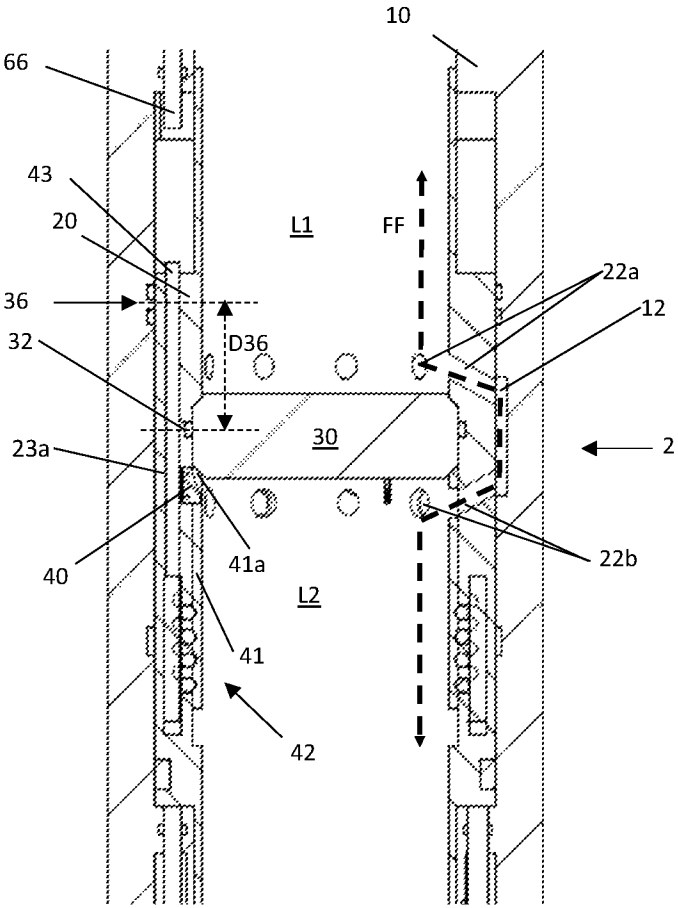
FIG. 5 illustrates an enlarged view of FIG. 1.

In FIG. 1 and FIG. 4, it is shown that the well tool device 1 comprises an axial fluid passage 2, allowing fluid to bypass the frangible disc 30. This bypass fluid flow is indicated by arrow FF1 between a first location L1 above the frangible disc 30 and a second location L2 below the frangible disc 30. It should be noted that FF1 is bidirectional, i.e. fluid may flow from the first to the second location and from the second to the first location, dependent on the fluid pressure on the respective sides of the disc 30.

In FIG. 5, it is shown that the axial fluid passage 2 comprises first and second fluid lines 22*a*, 22*b* provided in a radial direction through the sleeve section 20, i.e. from the bore 21 on the inside of the sleeve section 20 to the bore 11 or 11*a* of the housing 10 outside of the sleeve section 20. The first fluid line 22*a* is located above the disc 30, and the second fluid line 22*b* is located below the disc 30. In addition, the axial fluid passage 2 comprises a third fluid line 12 provided as an axial recess in the housing 10. The third fluid line 12 provides fluid communication between the first and second fluid lines 22*a*, 22*b*. Hence, as shown in FIG. 5, fluid is allowed to flow from the first location L1, through the first fluid line 22*a*, through the third fluid line 12, through the second fluid line 22*b* and then to the second location L2. As mentioned above, fluid flow in the opposite direction is also possible. From FIG. 5 it is apparent that the well tool device 1 comprises several such axial fluid passages 2 spaced apart from each other circumferentially around the sleeve section 20 and housing 10.

Hence, in the initial state S1 of FIGS. 1 and 5, the well tool device 1 is said to be open, as fluid flow through the device 1 is allowed via the axial fluid passage 2 bypassing the frangible disc 30.

First Actuating System 50 and Second Actuating System 60

The well tool device 1 comprises a first actuating system 50 and a second actuating system 60, shown in FIG. 1. The first and second actuating systems 50, 60 are provided in the housing 10, for example within a compartment of the housing 10. The first actuating system 50 is provided in the lower part of the housing 10, while the second actuating system 60 is located in the upper part of the housing 10.

The first actuating system 50 comprises a valve control system 51 for controlling a valve 52. The first actuating system 50 further comprises a piston 54 axially displaceable within a piston cylinder 55. A first, lower, side of the piston 54 is faced towards the valve 52, while a second, upper, side of the piston 54 is faced towards the sleeve section 20.

A first fluid line 53*a* is provided between the bore 11 and the valve 52. A second fluid line 53*b* is provided between the valve 52 and the lower part of the piston 54. Hence, the first side of the piston 54 is provided in fluid communication with the valve 52. The second side of the piston 54 is connected to the sleeve section 20 by means of a rod 56.

The valve 54 can be controlled to be in two different positions, a first position in which the valve 54 is preventing fluid flow between the first and second fluid lines 53*a*, 53*b* and a second position in which the valve 54 is allowing fluid flow between the first and second fluid lines 53*a*, 53*b*.

The second actuating system 60 comprises a valve control system 61 for controlling a valve 62. The second actuating system 60 further comprises a piston 64 axially displaceable within a piston cylinder 65. A first, upper, side of the piston 64 is faced towards the valve 62, while a second, lower, side of the piston 64 is faced towards the sleeve section 20.

A first fluid line 63*a* is provided between the bore 11 and the valve 62. A second fluid line 63*b* is provided between the valve 62 and the lower part of the piston 64. Hence, the first side of the piston 64 is provided in fluid communication with the valve 62. The second side of the piston 64 is connected to a piston rod 66. The piston rod 66 is used to release the connection device 42. In FIG. 2, it is shown that the piston rod 64 is provided in contact with an actuating rod 43 of the releasable connection device 42. The actuating rod 43 is provided in a compartment within the sleeve section 20.

The valve 64 can be controlled to be in two different positions, a first position in which the valve 64 is preventing fluid flow between the first and second fluid lines 63*a*, 63*b* and a second position in which the valve 64 is allowing fluid flow between the first and second fluid lines 63*a*, 63*b*.

The valve control system 51 may comprise an electric actuator for controlling the valve 52. The electric actuator can control the valve 52 to open at a predetermined time by using a timer, at a signal detected by a sensor, for example a signal in the form of hydraulic pulses detected by a pressure sensor, electromagnetic signals detected by an antenna etc. In the present embodiment, pressure pulses are detected by the valve control system 51 via openings 59 to the bore 11. In similar way, the valve control system 61 of the second actuating system 60 detects pressure pulses via openings 69 to the bore 11.

It should be noted that the number of pulses needed for the valve control system 51 to actuate the valve 52 is different than the number of pulses needed to actuate the valve 62, as the first actuating system 50 should be actuated before the second actuating system 60.

It should also be noted that the pressure within the fluid cylinders 55, 65 on the second side of the pistons 54, 64, i.e. on the upper side of piston 54 and on the lower side of piston 64, is lower or substantially lower than the expected well pressure in the well. Such a lower or substantially lower pressure can be a so-called atmospheric pressure as discussed in the introduction above.

The Sleeve Locking System 4

The sleeve locking system 4 mentioned above will now be described with reference to FIGS. 1 and 2. The sleeve locking system 4 comprises a first recess 14 provided in the bore 11 of the housing 10, a second recess 24 provided in an outer surface of the sleeve section 20 and a pre-tensioned locking device 34 provided in the first or second recess 14, 24. In the present embodiment, the pre-tensioned locking device 34 is a pre-compressed locking ring or a so-called snap ring, which in the initial state S1 is provided in the second recess 24.

In FIG. 1, the first and second recesses 14, 24 are provided axially displaced from each other. In FIG. 2, the first and second recesses 14, 24 are axially aligned with each other. Here, the locking ring expands partially into the first recess 14 and hence prevents relative axial movement between the housing 10 and the sleeve section 20.

Operation of the Well Tool Device

The operation of the well tool device 1 will now be described.

In the initial state S1 of FIGS. 1 and 5, bidirectional fluid flow FF1 is allowed through the device 1. In this state, fluids in the wellbore can be replaced.

When desired, the well tool device 1 can be actuated to its intermediate state S2. In the present embodiment, this is done by changing the pressure in bore 11 in a predetermined pattern, such as by cycling the pressure a predetermined number of times. This will actuate the valve control system 51 of the first actuating system 50, causing the valve 52 to rotate and allowing the fluid in the bore 11 to enter the piston cylinder 55 on the first side of the piston 54, which again will cause the piston 54 to push the sleeve section 20 upwardly by means of the piston rod 56.

The sleeve section 20 will move upwardly until the second stop profile 26 contacts or engages the first stop profile 16, as indicated by the distance D36. When the sleeve section 20 is in this position, the first and second recesses 14, 24 are axially aligned with each other, and the sleeve locking system 4 provides that the sleeve section 20 is axially locked to the housing 10. The well tool device 1 is now in the intermediate state. It should be noted that it is not possible to move the sleeve section 20 downwardly again, as the sleeve locking system 4 will prevent such movement.

As shown in FIGS. 2 and 6, the axial fluid passage 2 is now closed. As described above, the o-rings 32 and 36 are axially aligned. Now, the o-rings 36 are located between the first and third fluid lines 22*a*, 22*b*.

In this intermediate state, the actuating rod 43 is moved together with the sleeve section 20 to a position where the actuating rod 43 is in contact with the piston rod 66 of the second actuating system 60.

In this intermediate state, the completion string or tubing string above the well tool device can be pressure tested.

When desired, the well tool device 1 can be actuated to its final state S3. In the present embodiment, this is done in two substeps. The first substep is to change the pressure in bore 11 (above the disc 30) in a predetermined pattern, such as by cycling the pressure a predetermined number of times. This will actuate the valve control system 61 of the second actuating system 60, causing the valve 62 to rotate and allowing the fluid in the bore 11 to enter the piston cylinder 65 on the first side of the piston 64, which again will cause the piston 64 to push the actuating rod 43 downwardly by means of the piston rod 66

This will again release the releasable connection device 42, causing that the disc supporting device 41 becomes released from the sleeve section 20.

The second substep is to increase the pressure above the disc 30, in order to push the disc 30 downwardly towards the disintegration device 40. As the disc supporting device 41 is released, the disc supporting device 41 will be pushed downwardly with the disc 30.

As the disc 30 comes into contact with the disintegration device 40, the disc will disintegrate as shown in FIGS. 3 and 7 into small fragments, which will be transferred with the well flow.

In FIG. 4, the final state S3 is shown, where a second bidirectional fluid flow FF2 is indicated. As described above, the inner diameter of the well tool device 1, indicated by diameters D11 and D21, can be equal to the inner diameter of the string being connected to the well tool device 1.

Hence, the well tool device 1 does not represent a fluid restriction in the string in the final state S3. In the third state S3, the well tool device 1 allows full production through the bores 11, 21.

In the description above, the sleeve section 20 is moved upwardly from the first state S1 to the intermediate and closed state S2. This is an advantage, as in this closed state, the first stop profile 16 of the housing in contact with the second stop profile 26 of the sleeve, where it is relatively easy to dimension these profiles to withstand the expected well pressure. If the sleeve section 20 was to move downwardly from the initial to the closed state, the locking mechanism for locking the sleeve section in the closed state must be dimensioned and tested to handle the expected well pressure—which may be difficult to obtain.

Another advantage is that if there is a failure in the first actuating system 50, it will still be possible to close the well tool device 1. This can be performed by increasing the pressure in the entire well, i.e. increasing the pressure above and below the disc 30 (typically increasing the pressure towards the production packer). Then, the pressure can be bled off from the top side, causing the pressure to be higher below the disc 30 than above the disc 30. This pressure difference over the axial fluid passage 2 will then be so large that the sleeve section 20 will be pushed upwardly by means of the differential pressure over the axial fluid passage 2.

ALTERNATIVE EMBODIMENTS

It should be noted that in case the well tool device 1 is intended to be provided in the bottom end of a completion pipe, the lower connection interface 13*b* may be used for connection to a mule shoe or a wireline re-entry guide.

The enlarged section 11*a* of the bore 11 is not essential for the present invention. The axial displacement of the sleeve section 20 can be limited by other types of stops causing an engagement between the sleeve section 20 and the housing 10. However, without the enlarged section 11*a*, it is assumed that the diameter D21 of the sleeve section 20 would have to be substantially smaller than the diameter D11 of the bore 11.

The pistons 54, 64 are described above to be mechanically connected to the sleeve section 20 and the actuating rod 43 respectively. It should be noted that a further piston can be provided in the fluid cylinder or in fluid communication with the fluid cylinder, where the further piston is connected to the sleeve section 20. In such a case, the pistons 54, 64 can be considered to be hydraulically connected to the sleeve section 20 and the actuating rod 43 respectively.

The invention claimed is:

1. A well tool device comprising:

a housing having an axial through bore;

a sleeve section axially displaceable relative to the housing, wherein the sleeve section comprises an axial through bore aligned with the axial through bore of the housing;

a fluid flow preventing frangible disc; and an axial fluid passage bypassing the frangible disc when the well tool device is in an initial state, thereby allowing a fluid flow between a first location above the frangible disc and a second location below the frangible disc;

wherein the axial fluid passage is closed when the well tool device is in an intermediate state;

the fluid flow preventing frangible disc is provided in the bore of the sleeve section in sealing engagement with the sleeve section;

the well tool device further comprises a disc supporting device for supporting the frangible disc in relation to the sleeve section, wherein the disc supporting device is releasably connected inside the sleeve section by means of a releasable connection device;

the well tool device further comprises a disintegration device for disintegration of the frangible disc, wherein the well tool device is in a final state when the frangible disc has been disintegrated by means of the disintegration device;

the disintegration device is fixed to the sleeve section on a same side of the frangible disc as the disc supporting device; and the frangible disc is configured to be pushed axially relative to the sleeve section towards the disintegration device after release of the disc supporting device.

2. The well tool device according to claim 1, further comprises a sleeve locking system for preventing relative axial displacement between the housing and the sleeve section when the well tool device is in the intermediate state.

3. The well tool device according to claim 2, wherein the sleeve locking system comprises:

a first recess provided in the bore of the housing;

a second recess provided in an outer surface of the sleeve section, wherein the first and second recesses are axially aligned in the intermediate state; and a pre-tensioned locking device provided in the first or second recess, wherein the locking device is configured to lock the first and second recesses to each other in the intermediate state.

4. The well tool device according to claim 1, further comprises a first actuating system for moving the sleeve section axially in relation to the housing from the initial state to the intermediate state.

5. The well tool device according to claim 4, wherein the first actuating system comprises:

a valve control system;

a valve controlled by the valve control system;

a first fluid line provided between the bore and the valve;

a piston axially displaceable within a piston cylinder; and a second fluid line provided between a first side of the piston and the valve;

wherein:

a second side of the piston is connected to the sleeve section;

the valve is preventing fluid flow between the bore and the first side of the piston in the initial state; and the valve is allowing fluid flow between the bore and the first side of the piston in the intermediate state, thereby causing linear movement of the piston within the piston cylinder and hence axial movement of the sleeve section.

6. The well tool device according to claim 1, wherein:

the housing comprises a first stop profile within the bore;

the sleeve section comprises a second stop profile on its outer surface;

wherein the second stop profile is engaged with the first stop profile in the intermediate state.

7. The well tool device according to claim 1, further comprises a second actuating system for releasing the releasable connection device, thereby causing a release of the disc supporting device from the sleeve section.

8. The well tool device according to claim 7, wherein the second actuating system comprises:

a valve control system;

a valve controlled by the valve control system;

a first fluid line provided between the bore and the valve;

a piston axially displaceable within a piston cylinder; and a second fluid line provided between a first side of the piston and the valve;

wherein a second side of the piston is connected to the releasable connection device;

the valve is preventing fluid flow between the bore and the first side of the piston in the initial state and intermediate state; and the valve is allowing fluid flow between the bore and the first side of the piston to initiate the final state, thereby causing linear movement of the piston within the piston cylinder and hence release of the releasable connection device.

9. The well tool device according to claim 8, wherein the second actuating system and the releasable connection device are provided on opposite sides of the frangible disc.

10. The well tool device according to claim 8, wherein a piston rod in one end is connected to the second side of the piston, and in a second end is provided in contact with an actuating rod of the releasable connection device.

11. The well tool device according to claim 10, wherein the actuating rod is provided in an axial bore provided in the sleeve section.

* * * * *